United States Patent [19]

Fisher

[11] Patent Number: 4,550,040

[45] Date of Patent: Oct. 29, 1985

[54] MOVABLE MOSAICS

[75] Inventor: Denys Fisher, Glencaple, England

[73] Assignee: Waddingtons Games Limited, Leeds, England

[21] Appl. No.: 480,059

[22] Filed: Mar. 29, 1983

[30] Foreign Application Priority Data

Mar. 31, 1982 [GB] United Kingdom ..... 8209571

[51] Int. Cl.[4] ..... A63F 9/08; B44F 11/04

[52] U.S. Cl. ..... 428/33; 273/153; 428/47

[58] Field of Search ..... 428/13, 33–39, 428/47, 48, 49; 273/153

[56] References Cited

U.S. PATENT DOCUMENTS 4,177,305 12/1979 Feingold et al. ..... 428/13

4,415,158 11/1983 Engel ..... 273/153

FOREIGN PATENT DOCUMENTS 8123478 1/1982 Fed. Rep. of Germany ..... 273/153

2117256 10/1983 United Kingdom ..... 273/153

*Primary Examiner*—Henry F. Epstein

*Attorney, Agent, or Firm*—David A. Jackson; Daniel H. Bobis

[57] ABSTRACT

A movable mosaic formed by intersecting defined circular members each of which is rotatable about its center point and each of which comprises a plurality of discrete pieces formed by intersecting arcs of said circular members, said intersecting arcs having a radial dimension equal to the radial dimension of said circular members, each said plurality of discrete pieces including a first group of pieces whose arcuate surfaces are all convex and a second group of pieces whose arcuate surfaces are all concave.

Some of the pieces of each plurality of pieces will be common to at least two of said circles, said pieces being interchangeable between the circles by moving the pieces about the theoretical center points of said circles.

5 Claims, 15 Drawing Figures

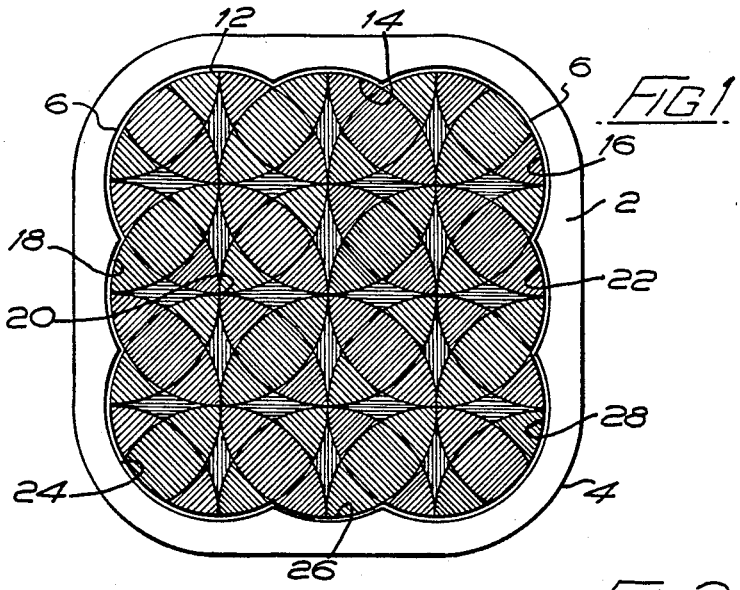
FIG 1
FIG 2
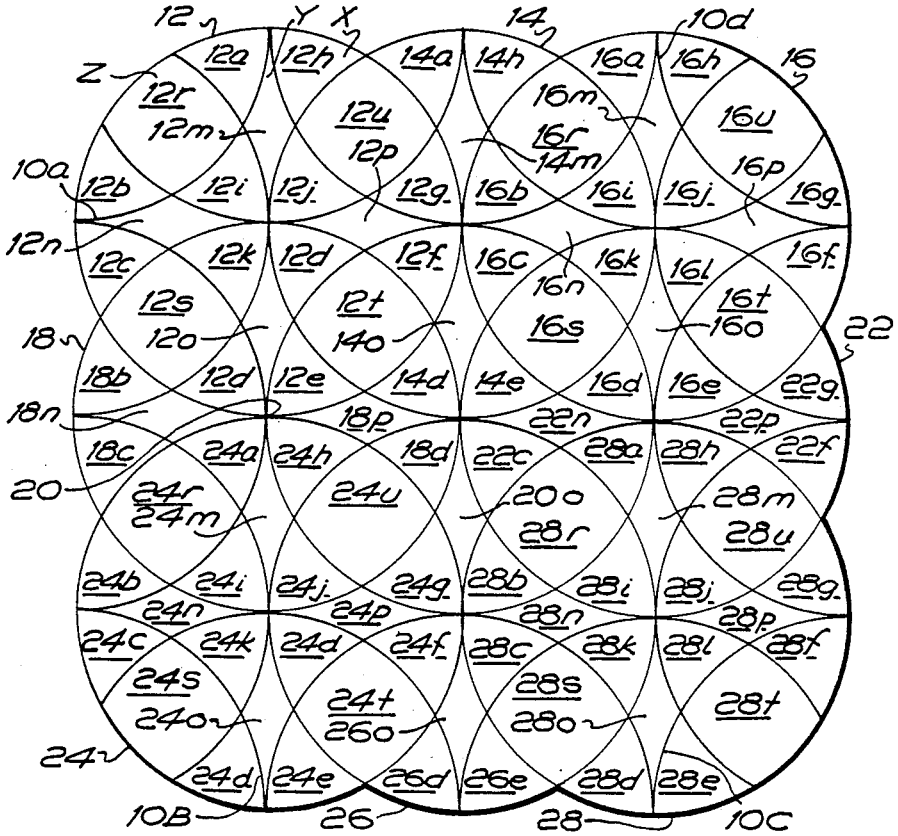

MOVABLE MOSAICS

This invention relates to movable mosaics.

Movable mosaics according to the invention may be utilised in a number of ways. For example, such movable mosaics may be utilised as a puzzle, as a movable jig-saw puzzle, as a design and shape former of ever-changing characteristics. In addition, movable mosaics according to the invention may be adapted for use as a video game for use with a television receiver, or as a hand-held game, or even further as an "arcade" game.

It has previously been proposed to provide a movable mosaic in the form of what might loosely be termed a "board game" which consists of a plurality of intersecting circular numbers within a frame, each circular member having four seperable portions. Each portion is defined at one side by an arc forming a part of the circumference of the circular member and at the other side by an internal arc of said circular member, the arcs of said portion being of the same radial dimension as the radial dimension of the circular members. Where the circular members intersect, the portions lying within the intersecting circumferences of the circular members are common to said intersecting circular members.

By rotation of one of a pair of intersecting circular members about its centre relative to the other of said pair of intersecting circular members, the common portion may be caused to change its position relative to the intersecting circular members—whereupon it may form a common portion of another pair of intersecting circular members—and simultaneously a further portion takes the place vacated by said common portion, so that said further portion then becomes the common portion.

The formation of the portions of said circular members in the above—described manner results, according to the prior proposal, in a central portion which, although it can be rotated about its centre and hence cause movement of its associated portions, cannot itself move or "migrate" to another, intersecting circle. Thus, whilst a movable mosaic according to the prior proposal has its attractions as a game, it has limitations as to the extent to which it can be used, both as a game and in other applications.

It has also been proposed to provide a movable mosaic consisting of a plurality of intersecting circular members within a frame, each of the circular members consisting of six seperable portions, some of said seperable portions being common to two or more of the circular members. The seperable portions of the circular members each have three arcuate surfaces, either convex or concave, or a combination thereof, and whilst the arcuate surfaces have a common radial dimension, one portion of each of the circular members cannot leave or migrate from that circle. Thus all of the portions of the circular members are not fully interchangeable and movable from one circular member to another, and therefore the use and scope of variation of the movable mosaic of this prior proposal is determined by the inherent limitation of movement of said one portion of each of the circular members.

The present invention therefore seeks to provide a movable mosaic which will obviate the disadvantages and limitations of the prior proposal.

According to the present invention, there is provided a movable mosaic formed by intersecting defined circular members each of which is rotatable about its centre point and each of which comprises a plurality of discrete pieces formed by intersecting arcs of said circular members, said intersecting arcs having a radial dimension equal to the radial dimension of said circular members, each said plurality of discrete pieces including a first group of pieces whose arcuate surfaces are all convex and a second group of pieces whose arcuate surfaces are all concave.

Preferably, each plurality of discrete pieces will include a third group of pieces, the pieces of said third group having two convex arcuate surfaces and one concave arcuate surface.

Some of the pieces of each plurality of pieces will be common to at least two of said intersecting defined circular members.

In its preferred form, the movable mosaic will comprise a minimum of thirty-three movable elements formed by a plurality of intersecting arcs, said thirty-three elements consisting of twenty elements of a first shape which is generally triangular with two convex sides and one concave side, seven elements of a second shape which is generally rhombic and whose sides are all concave, and six elements of a third shape which is generally square and whose sides are all convex, the radius of the external surfaces of all of said elements being equal or substantially equal, the thirty-three elements being assembled into a group with no voids such that the group can be seen as the intersection of two circles each having a radius equal to the radius of the external surfaces of the elements.

Each of said intersecting arcs will pass through one or other of the theoretical centre points of the two intersecting circles, and the points of arc will be arranged on a squared lattice.

The two intersecting circles will each be rotatable about its theoretical centre point such that all of the elements are transferrable from one circle to the other.

The movable mosaic may comprise one hundred elements consisting of a plurality of elements of said first shape, a plurality of elements of said second shape, and a plurality of elements of said third shape, said elements being assembled into a group with no voids such that the group can be seen as the intersections of nine circles each having a radius equal or substantially equal to the radius of the external surfaces of said elements, each circle being rotatable about its theoretical centre point such that all of the elements of one circle are fully interchangeable with the elements of any other circle.

In an alternative embodiment of the invention, the movable mosaic, in its simplest form, will consist of a minimum of twenty-nine elements formed by a plurality of intersecting arcs, said twenty-nine elements consisting of nineteen elements of a first shape whose sides are convex, and ten elements of a second shape which are generally triangular and whose sides are concave.

The movable mosaic according to this embodiment may comprise more than two circular members, each consisting of a plurality of elements of said first shape and a plurality of elements of said second shape.

The elements of the movable mosaics may be of differing colours so as to facilitate easier recognition of the several intersecting circles.

Preferably said movable mosaic will be located within a frame whose walls limit the movement of the elements of the movable mosaic.

In order that the invention may be more readily understood, an embodiment thereof will now be described, by way of example, reference being made to the accompanying drawings.

BRIEF DESCRIPTION OF THE DRAWINGS

FIG. 1 is a plan view of a movable mosaic according to a preferred embodiment of the invention;

FIG. 2 is a plan view of part of FIG. 1 to a larger scale; and

Figure 3:
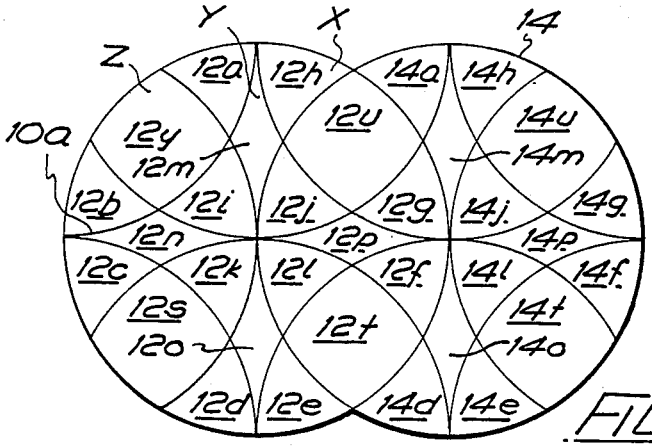
FIG. 3 is a plan view of a movable mosaic according to the invention and showing the movable mosaic in its simplest form.

Referring to the drawings, and firstly to FIG. 1, there is shown a movable mosaic housed in a frame 2, the mosaic comprising a plurality of elements which are assembled into a group with no voids such that the group can be seen as the intersections of nine circles each of which is rotatable about its theoretical centre point.

The frame 2 comprises a base 4 and upstanding walls 6 which define an area within which the elements can be moved. The base 4 and upstanding walls 6 may be seperate items secured together from example by screws or by an adhesive, or the base 4 and walls 6 may be formed integrally. The base 4 and walls 6 may be composed of plastics material, card or board, or of other suitable materials.

The intersecting circles which are referenced 12, 14, 16, 18, 20, 22, 24, 26 and 28 each consist of a plurality of discrete elements of plastics material, card or board or other suitable material formed by intersecting arcs of equal radius, this radius also being equal to the radius of each of the intersecting circles subject to allowances for working clearance. As will be seen, each arc passes through the theoretical centre point of one or other of the circles. The exception to this, see FIG. 2, are the arcs referenced 10A, 10B, 10C and 10D (as illustrated), although it will be appreciated that if additional circles were constructed, then these arcs too would pass through the centre of one or other of the circles. It will be seen from FIG. 2 that the points of arc are arranged on a squared lattice.

As will best be seen from FIG. 2, the elements of the intersecting circles comprise a plurality of elements of a first shape which is generally triangular and which has two convex sides and one concave side, a plurality of elements of a second shape which is generally rhombic and whose sides are all concave, and a plurality of elements of a third shape which is generally square and whose sides are all convex. Examples of the said three elements are indicated for the purpose of identification by reference letters X, Y and Z respectively. In the embodiment illustrated there are one-hundred elements - sixty elements of the first shape, twenty-four elements of the second shape and sixteen elements of the third shape.

The circles, 12, 16, 24 and 28 each consist of twelve generally triangular elements referenced 12*a* to 12*d*, 16*a* to 16*d*, 24*a* to 24*d*, 28*a* to 28*d* respectively, four rhombic elements referenced 12*m* to 12*p*, 16*m* to 16*p*, 24*m* to 24*p*, 28*m* to 28*p* respectively, and four generally square elements referenced 12*r* to 12*u*, 16*r* to 16*u*, 24*r* to 24*u*, 28*r* to 28*u* respectively. The elements of one circle are all of the same colour, but of a different colour to the elements of the other circles, so that four differently coloured circles are readily visible.

The circles 14, 18, 20, 22 and 26 each include elements of two or more of the other intersecting circles. For example, the circle 14 is constituted by elements of the circles 12 and 16, and by elements 14*a*, 14*d*, 14*e* and 14*h* of the same form as the equivalent elements of the circle 12, and elements 14*m* and 14*o* of the same form as the equivalent elements of the circle 12. The circle 18 is constituted by some elements of the circular member 12—some of which are also common to the circular member 14—some elements of the circular member 24, and by elements 18*b*, 18*c*, 18*d* and the element 14*d* of the circle 14 as well as elements 18*n* and 18*p* of the same form as the equivalent elements of the circle 12. The circle 22 is formed in the same manner as circle 18, and the circle 26 is formed in the same manner as circle 14, and equivalent elements in the respective circles have been referenced accordingly. The centre circle 20 is composed of some of the elements of all of the other circles as indicated.

Those elements lying outside the circles 12, 16, 24 and 28, are of a differing colour to the colours of these circles so as to give better definition to said circles 12, 16, 24 and 28.

As previously mentioned, but subject to allowance for working clearance, the circles of the mosaic have the same radial dimension, which is equal to the radial dimension of the arcs, and the spacing of the theoretical centres of said circles is equal to this radial dimension.

It will be apparent that those elements of the group which lie outside the circles 12, 16, 24 and 28 cannot by themselves form a circle - regardless of the positions of those elements - since, although there are twenty elements there are no generally square elements such as the element 12*n*. Thus, these said elements are only used as "filler" elements to complete the number of elements of a circle, although they can and do form a part of the overall design created when the circles are moved relative to one another to cause "migration" of the elements making up the mosaic from one circle to the other.

The elements of the group will preferably have slots and/or projections (not shown) such that all of the elements are "interlocked" and yet remain capable of being moved relative to each other upon rotation of the circles. In addition, the base 4 or the frame 2 may have upstanding lands which can be engaged by recesses in some or all of the elements so as to give a "register" to said some or all of the elements and hence ensure that the elements are in a position to enable the circles to be rotated.

In one mode of use of a mosaic according to the invention, the object might be to move a selected element around the walls 6 of the frame 2 by rotating a circle about its centre so as to move the selected element to another position within the same selected circle and within an intersecting circle and continuing with this operation to determine how quickly one can reconstruct the circles 12, 16, 24, and 28. Thus, if one selects say element 12*s*, movement of the circle 12 a ½-turn clockwise about its theoretical centre point will change all of the positions of the elements of that circle so that element 12*s* will occupy the position previously occupied by element 12*u*, element 12*g* will occupy the position previously occupied by element 12*e* and so on. In addition to lying within the circle 12 the element 12*s* will also lie within the circle 14. Rotation then of the circle 14 a ¼-turn clockwise about its theoretical centre point will move the element 12*s* to the position previously occupied by element 16*r*. This sequence of rotation, moving the element 12*s* in contact with the upstanding walls of the frame member 2, will result in the elements of the circles migrating and immigrating between intersecting circles and continuance of this sequence of operations will eventually result in the reconstruction of the circles 12, 16, 24, and 28. Such will happen regardless of whether the movable mosaic is used as a puzzle or as a design aid, and where the movable mosaic is used as the latter some very unexpected but aesthetically pleasing designs, i.e. colour combinations, will be seen during movement of the defined circular members.

It will be appreciated that one may choose any desired path for movement of a selected element or selected elements, the only criterion being that where one of a pair of intersecting circles is to be rotated the circumferences of those intersecting circles must be clearly defined.

With a movable mosaic according to the invention, all of the elements of the mosaic may be moved from one circle to another circle, such that the positions of all of the elements are interchangeable, this being possible due to the selection of a common modular dimension, i.e. a radius which is common to each external surface of the elements, and the arrangement of the intersecting arcs.

It will be appreciated that a movable mosaic according to the invention may comprise more or less circles than shown in FIGS. 1 and 2. For example, FIG. 3 illustrates a movable mosaic according to the invention in its simplest and basic form. In the movable mosaic of FIG. 3, there is shown thirty-three elements—of the same forms as the elements previously described—assembled into a group with no voids such that the group can be seen as the intersection of two circles. For ease of reference, these circles can be equated to the circles 12 and 14 of FIGS. 1 and 2.

Figure 4:
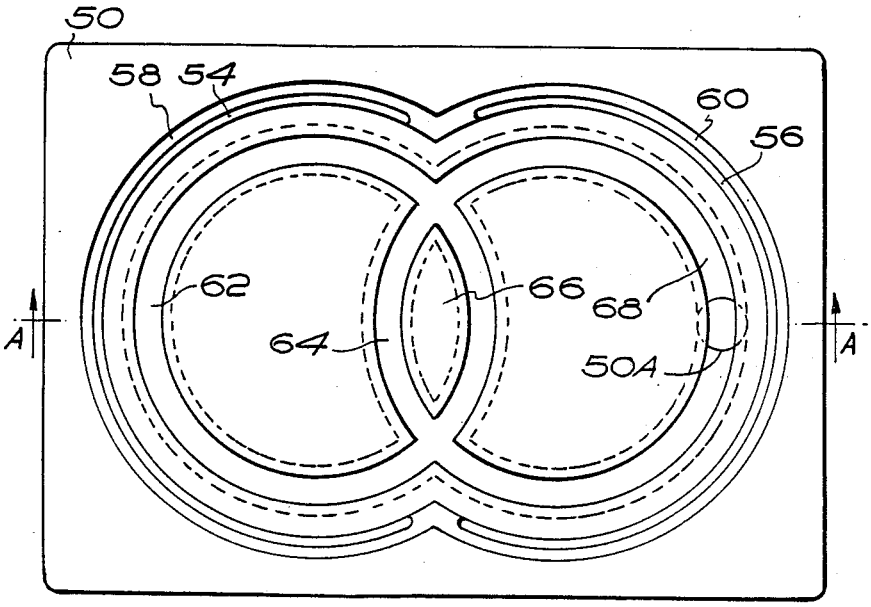
FIG. 4 is a plan view, to a larger scale, of a frame for use with the movable mosaic of FIG. 3.
Figure 5:
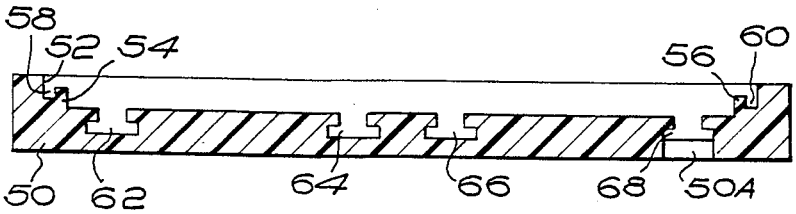
FIG. 5 is a sectional elevation or line V—V in FIG. 4.

Referring now to FIGS. 4 and 5, a frame 50 adapted to receive for example the movable mosaic of FIG. 3, has a series of flanges, grooves and tongues for co-operation with similar members on the elements of the movable mosaic. The frame 50 has an internal recess 52 formed by two intersecting circles, such that the movable mosaic of FIG. 3 may be located therein, the radial dimension of the intersecting circles of the recess being equal and equal to the radial dimension of the intersecting circles of the mosaic subject to allowances for working clearance. The frame 50 has downwardly extending flanges 54 and 56 defining grooves 58 and 60, and additionally has a T-slot system consisting of intersecting T-slots 62, 64, 66 and 68.

Figure 6:
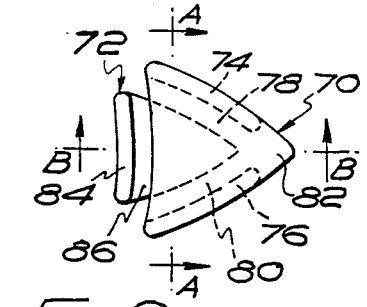
FIGS. 6 to 8 are respectively a plan view, a sectional end elevation and a sectional front elevation to a larger scale, of a generally triangular element forming part of the movable mosaic of FIG. 3.
Figure 7:
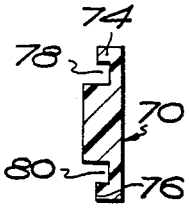
Figure 8:
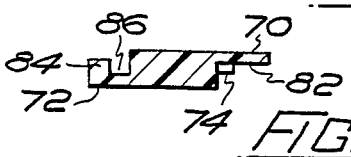

Reference to FIGS. 6 to 8 will show that the generally triangular elements each include a main body portion 70 and a "tail" portion 72 formed integrally with the main body portion. The main body portion 70 has flanges 74 and 76 which define grooves 78 and 80 which intersect to provide a tongue indicated at 82. The "tail" portion 72 has a flange 84 which with the main body portion 70 defines a groove 86.

The generally rhombic element, referring now to FIGS. 9 to 12, is provided with a central portion 90 and four upstanding flanges 92, 94, 96 and 98 which with the central portion 90 define four grooves 100, 102, 104 and 106 which intersect to provide tongues as indicated by reference numerals 108, 110, 112 and 114.

Figure 12:
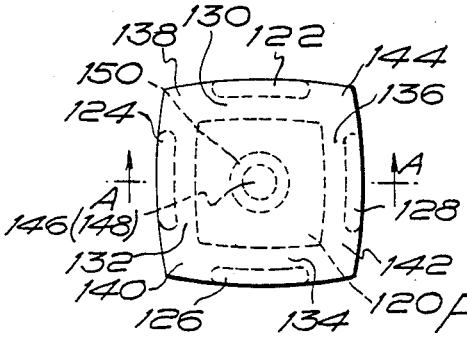
FIGS. 12 and 13 are views corresponding to those of FIGS. 6 and 8, but of the generally square element forming part of the movable mosaic of FIG. 3.
Figure 13:
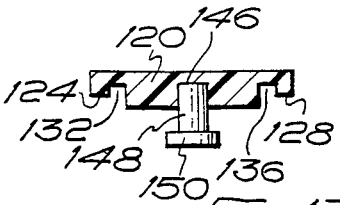

Referring to FIGS. 12 and 13, the generally square element shown comprises a central body portion 120, and four downwardly depending flanges 122, 124, 126 and 128, those flanges, together with the body portion 120, defining grooves 130, 132, 134 and 136 which intersect at the ends of the flanges to define tongues 138, 140, 142 and 144. The body portion 120 has a central bore 146 for receiving a stud 148 having a head 150.

Figure 9:
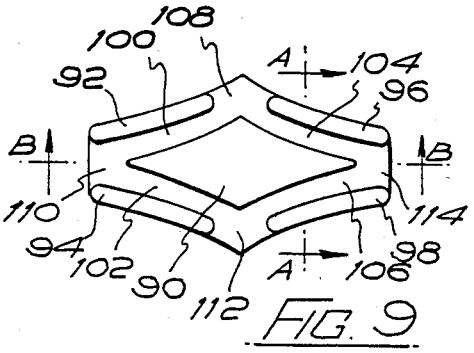
FIGS. 9 to 11 are views corresponding to those of FIGS. 6 to 8, but of a generally rhombic element forming part of the movable mosaic of FIG. 3.
Figure 10:
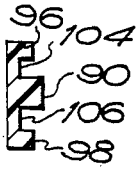
Figure 11:
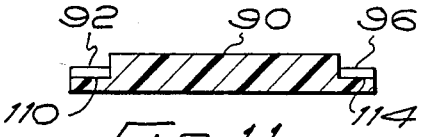

To assemble a movable mosaic as shown in FIG. 3, the generally rhombic elements—as shown in FIGS. 9 to 11—are inserted into the recess 52 of the frame 50 in the positions shown in FIG. 3 such that the generally rhombic elements present their flanges and hence their grooves upwardly. Thereafter, the generally triangular elements—as shown in FIGS. 6 to 8—are inserted in the positions as shown in FIG. 3 followed by the insertion of the generally square elements in the form as shown in FIGS. 12 and 13. Thus there is provided an interlocked and interslidable mosaic as shown in FIG. 3.

The generally rhombic elements are held down on the base of the frame 50 by the flanges and tongues of the generally triangular elements and by the appropriate flanges and tongues of the generally square elements because one of each or part of both must necessarily be in contact with the generally rhombic elements.

In turn, the generally triangular elements are held down to the base of the frame 50 by the flanges and tongues of the generally square elements which contact the flanges and tongues of the "tail" portions of the generally triangular elements, each generally square element serving to hold down three, and in some cases four, generally triangular elements.

Thus, with all of the elements in position as shown in FIG. 3, the inter-engagement of the elements will be as follows:

(a) The peripheral generally triangular elements will each have one flange and one groove (on a convex side) cooperating with one flange and one groove of the frame, one flange and one groove (on the other convex side) cooperating with a flange and a groove of a generally rhombic element, and the flange and groove on the concave side co-operating with a flange and groove of one side of one of the generally square elements.

(b) The centre generally triangular elements will each have the flanges and grooves on their convex sides cooperating with the flanges and grooves on two sides of the generally rhombic elements, and the flange and groove on its concave side co-operating with a flange and groove on one generally square element.

(c) The generally square elements will each have the flanges and grooves on three of its sides co-operating with the flanges and grooves on the concave sides of three generally triangular elements, the flange and groove on its fourth side co-operating with the flange and groove on the concave side of a fourth generally triangular member or with one of the flanges and one of the grooves of the frame 50.

Thus the parts are interconnected, slidable relative to each other, and totally interchangeable, the tongues of the various elements co-operating with each other.

To retain the generally square elements, each such element is adapted to receive in its recess 146 a stud, such as the stud 148 having the head 150, the studs being inserted into the recesses from the bottom or rear of the frame. For this purpose, the base of the frame 50 is provided with an aperture 50A (FIGS. 4 and 5) through which the studs can be inserted. Thus a generally square element will be positioned with its central recess above the aperture 50A such that a stud (such as 148) may be inserted into said recess with the result that the head 150 of the stud lies in the "T" of the T-slot 66. In turn the other generally square elements have studs inserted in the same way, such that their heads lie in a T-slot of the system formed by the T-slots 62, 64, 66 and 68. The aperture may then, if desired, have a closure inserted therein.

It will be appreciated that the fitting of the studs to the generally square elements result in a totally captive (subject to the studs being removable), but movable mosaic. Should such total captivity not be required then the studs need not be inserted, and the associated recessed T-slots omitted.

It will also be appreciated that more than one aperture 50A may be provided if desired, and that all of the above considerations are equally applicable to the movable mosaic of FIGS. 1 and 2.

Figure 14:
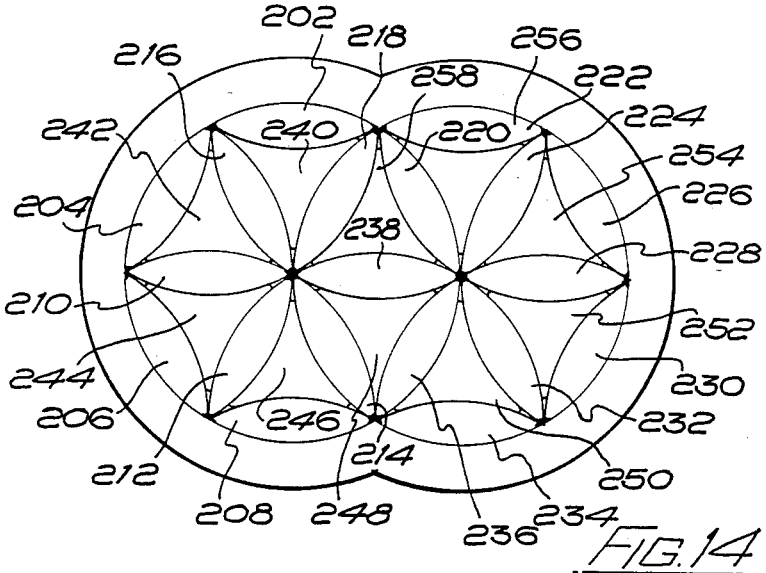
FIGS. 14 and 15 show alternative embodiments of movable mosaics according to the invention.

Referring now to FIG. 14, it will be seen that the movable mosaic, located within a keeper frame 200 of the same general characteristics as the frame 50 of FIG. 2, comprises twenty-nine movable elements. These twenty-nine movable elements consist of nineteen elements referenced 202 to 238 of a first shape whose two sides are convex, and ten elements referenced 240 to 258 of a second shape which is generally triangular and whose sides are all convex. The several elements will fit together and co-operate with each other in a manner similar to that described with reference to the previous embodiment, and like that embodiment, the elements will be fully interchangeable between the two intersecting defined circular members.

Figure 15:
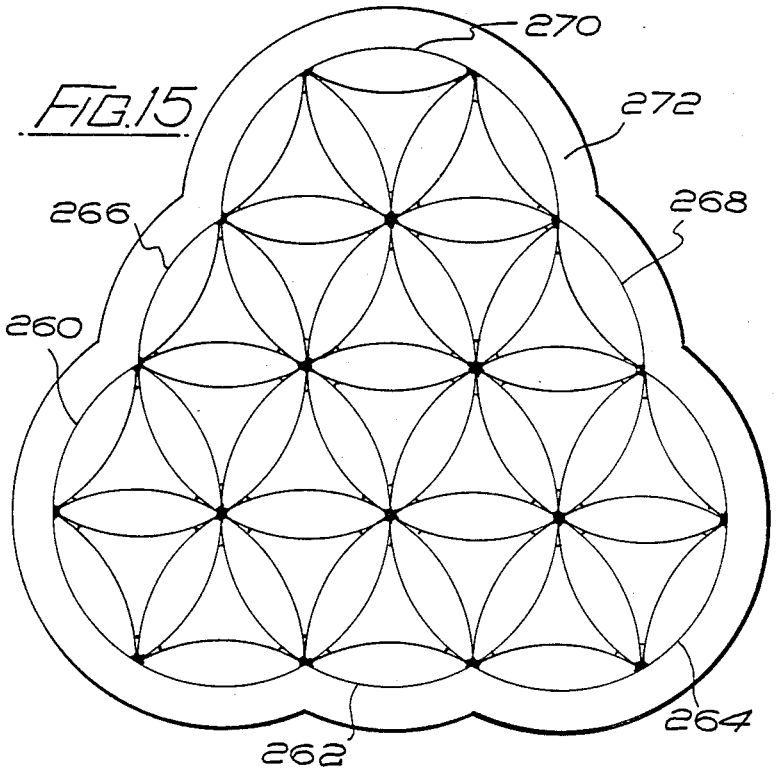

Reference to FIG. 15 will show elements identical to those of FIG. 14, but many more of them, arranged into a movable mosaic which can be seen from the Figure to be the intersection of six circles 260, 262, 264, 266, 268, and 270, each having a radius equal to the radius of the external surfaces of the elements, the circles being housed within a frame 272 which serves to guide and limit the movement of the elements.

A movable mosaic according to the present invention may be incorporated into or may constitute an electronic game, a video game for use with a television receiver, or an arcade game. For example, an electronic game will include circuitry and appropriate controls to cause rotation of the circles, such that say one depression of the appropriate control will cause a selected circle to rotate $\frac{1}{4}$-turn about its centre, two depressions will cause a $\frac{1}{2}$-turn rotation and so on, the object of the game being for example to arrange the colours in a certain pattern or arrangement. A video game for use with a television receiver may operate on the same general principle, i.e. to arrange the colours in a predetermined pattern or arrangement. A computerised movable mosaic may be adapted to operate in the same manner.

An arcade game may be arranged such that one actuation of the arm or one depression of a control button will caused rotation of a selected circle or a sequence of controlled sequential rotations, a "pay-out" on the machine being actuated when a predetermined arrangement of elements or a predetermined colour pattern is achieved.

A movable mosaic according to the invention may be incorporated into furniture such as coffee tables and the like, such that the design on the surface thereof may be changed at will so as to give a different arrangement of colours or patterns.

The movable mosaic may constitute a jig-saw where the elements of the circles each carry a part of a picture or other representation, the elements together defining the picture or other representation of the jig-saw, movement of the circles about their theoretical centres being necessary to move the elements from one circle to another to complete said picture or other representation.

I claim:

1. A movable mosaic comprising a plurality of substantially flat pieces defining at least two circles of the same radius, the pieces within each circle being rotatable about the center of the circle, all edges of the pieces making up each of said circles being defined by arcs of circles of said radius and within each circle there are defined by said edges (a) only four first arcs which pass through the center of the circle and which are equally angularly spaced relative to the circle, and (b) only four second arcs which are equally angularly spaced relative to the circle and which meet the circumference of the circle at right angles at locations which respectively bisect circumference sections subtended by said first arcs, said circles overlapping by an amount equal to said radius so that as regards any two overlapping circles, the circumference of each circle is partly defined by at least one of the first and second arcs of each adjacent circle, whereby any part of one circle can be moved into the corresponding portion in the other circle by sequentially rotating the circles.

2. A movable mosaic according to claim 1, wherein there are defined nine of said overlapping circles arranged in a square array, one of said circles being a center circle overlapping all other eight circles so that the circumference forms one of the first arcs in respective circles positioned in the center of the sides of the square array, and one of the second arcs in respective circles positioned at the corners of the square array.

3. A movable mosaic according to claim 1, wherein said movable mosaic is located within a frame whose walls limit and guide the movement of the pieces of the movable mosaic.

4. A movable mosaic according to claim 2, wherein said movable mosaic is located within a frame whose walls limit and guide the movement of the pieces of the movable mosaic.

5. A movable mosaic according to claim 1 wherein the pieces of the movable mosaic are interlocked by means of flanges and grooves formed on said pieces.

* * * * *